US005700188A

United States Patent [19]

Uhlmann et al.

[11] Patent Number: 5,700,188

[45] Date of Patent: Dec. 23, 1997

[54] COATED ABRASIVE BELT

[75] Inventors: Eckart Uhlmann, Kiebietzreihe; Gerhard Struth, Hamburg, both of Germany

[73] Assignee: Hermes Schleifmittel GmbH, Hamburg, Germany

[21] Appl. No.: 756,481

[22] Filed: Nov. 26, 1996

[30] Foreign Application Priority Data

Nov. 29, 1995 [DE] Germany ..... 295 18 953 U

[51] Int. Cl.[6] ..... B24D 11/00

[52] U.S. Cl. ..... 451/532; 451/531; 451/533; 451/526

[58] Field of Search ..... 451/531, 532, 451/489, 526, 533, 539, 921, 536

[56] References Cited

U.S. PATENT DOCUMENTS

| | | | |
|---|---|---|---|
| 1,728,673 | 9/1929 | Driver . | |
| 2,350,861 | 6/1944 | Argy et al. | 451/531 |
| 3,637,359 | 1/1972 | Manoy et al. | 451/531 |
| 3,729,873 | 5/1973 | Sandell | 51/399 |
| 4,018,574 | 4/1977 | Dyer | 451/531 |
| 4,215,516 | 8/1980 | Huschle et al. | 51/399 |
| 4,589,233 | 5/1986 | Parekh et al. | 51/399 |
| 4,736,549 | 4/1988 | Toillié | 51/399 |
| 5,305,560 | 4/1994 | Roelofs | 451/531 |
| 5,341,609 | 8/1994 | Gorsuch et al. | 451/533 |
| 5,529,590 | 6/1996 | Ennis et al. | 451/531 |
| 5,573,619 | 11/1996 | Benedict et al. | 451/531 |
| 5,595,804 | 1/1997 | Korbel | 451/531 |

FOREIGN PATENT DOCUMENTS

| | | | |
|---|---|---|---|
| 60048264 | 3/1985 | Japan | B24D 11/06 |
| WO 90/08035 A1 | 7/1990 | WIPO | B32B 31/08 |

*Primary Examiner*—James G. Smith
*Assistant Examiner*—Derris H. Banks
*Attorney, Agent, or Firm*—Alix, Yale & Ristas, LLP

[57] ABSTRACT

A coated abrasive belt with an abrasive grain layer on one side of a flexible substrate. The substrate comprises a longitudinal strength layer (4, 5) and a transverse strength layer (6, 7). The edges of successive coated abrasive belt portions are adhesively bonded directly to one another by the use of a recess formed at least in the transverse strength layer. Adhesive bonding takes places one a connecting face (10) which runs approximately in the longitudinal direction and which reaches at least near to the longitudinal strength layer (4, 5). One of the two portions (2) carries the grain layer (14) on its longitudinal strength layer (4) and the other carries it on its transverse strength layer (7).

21 Claims, 2 Drawing Sheets

Fig. 7
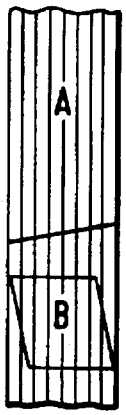
Fig. 8
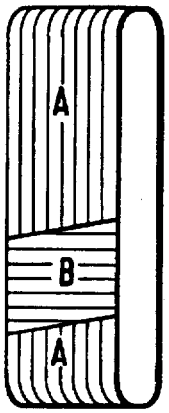
Fig. 3
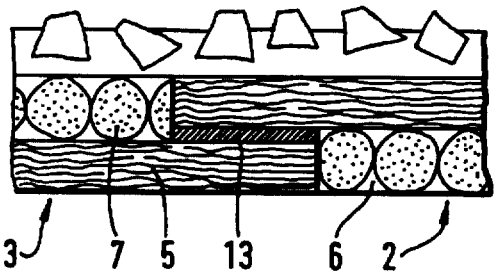
Fig. 9
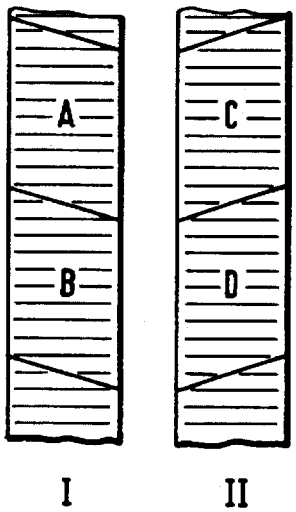
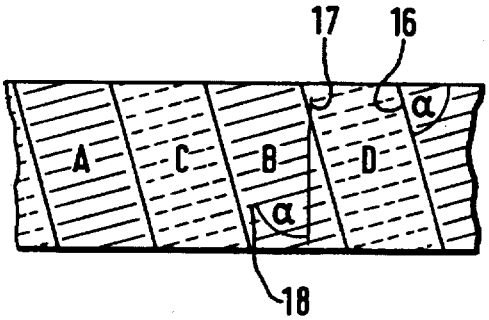
Fig. 10
Fig. 11
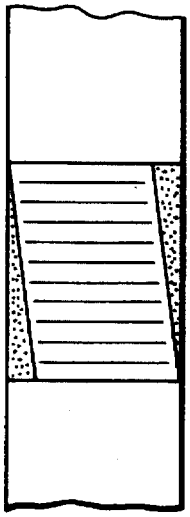
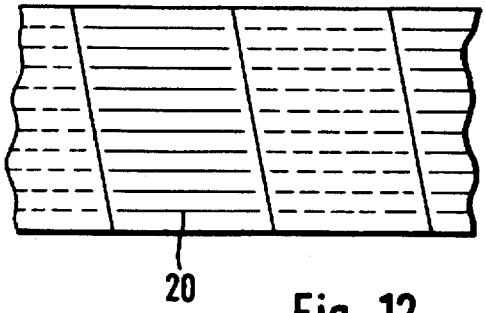
Fig. 12

COATED ABRASIVE BELT

The joint of a coated abrasive belt is a particularly sensitive part because it may fail prematurely. It may also influence the ground section because, inter alia, the flexibility of the material in the section of said joint differs from that of the remaining coated abrasive belt.

It is known to connect the two edges of the coated abrasive belt substrate which are adjacent to the joint by milling a rebate with oblique or rectangular shapes on their side facing away from the abrasive grain layer, so as to form, on both sides, a recess, into which a joining compound (U.S. Pat. No. 3,729,873) solidifying from the flowable state is introduced or a joining strip (U.S. Pat. No. 1,728,673, U.S. Pat. No. 4,215,516) is inserted. This technique has proved appropriate, in particular for those substrates which, on the side facing the abrasive grain layer, have a set of mutually parallel nonwoven threads which are held together in the transverse direction by a further layer which is located on their side facing away from the abrasive grain layer and in which the rebate for the joining strip is located (EP-B 213 353); in this case, the joining strip can be connected directly, in each of the two edges, with the layer responsible for transmitting the longitudinal forces. Nevertheless, it can not be avoided that, as far as flexibility and geometry are concerned, the joining section may differ significantly from other sections of the belt. Also, as in all known joining techniques, a large amount of manual labor, together with the possibilities of error resulting from this, is unavoidable.

In a coated abrasive belt of the last-mentioned type, the invention improves the joining point in the terms of lifetime, flexibility and dimensional and fitting accuracy, The solution according to the invention is found in the features of claim 1.

Accordingly, use is made of a substrate which, as in the known case, consists of two layers, one layer of which is designed in such a way that it can absorb mainly the forces extending in the band running direction and is therefore designated here as a longitudinal strength layer. It expediently consists of drawn nonwoven strands ore threads. The second layer is designed predominantly for absorbing the forces extending in the transverse direction and is therefore designated here as a transverse strength layer.

As in the known case, the two edges to be joined in the transverse strength layer are provided with matching rebates. In the seam cross section, the face of this recess which runs approximately in the longitudinal direction reaches approximately up to or even into the longitudinal strength layer. Since the connecting force is mainly transmitted via this face, it is designated as the connecting face.

The new features of the invention are that one of the two portions to be connected carries the grain layer on its longitudinal strength layer and the other carries said grain layer on its transverse strength layer, and that those edge strips of the longitudinal strength layer of each of the two edges which project in the region of the recess are located in the recess of the other edge in each case, the connecting faces of the two rebates being adhesively bonded directly to one another.

This is preferably achieved, in the case of wide belts, in that the threads running transversely to the production direction form the longitudinal strength layer and the latter alternately forms the top side and the underside of the abrasive belts. The grain layer is therefore located alternately on the substrate thread layer running longitudinally and transversely relative to the production direction.

In coated abrasive belts, the width of which does not exceed the production width of the substrate, the grain layer is preferably applied uniformly to one and the same thread layer of the substrate. The connection of the thread layers running in each case in the longitudinal direction becomes possible if the portions to be connected differ in each case by approximately 90° in terms of the orientation of their production direction.

This avoids the need, in both cases, for a belt like connecting member which overlaps on both sides and which bridges a gap between the edges to be connected. The direct adhesive bonding of the projecting edge strips of the longitudinal strength layers does away with a special connecting element, and only one adhesive bond is necessary instead of two of these. The connection reliability is thereby considerably increased and the force flux becomes more favorable. The surfaces, particularly suitable for adhesive bonding, in the region of the recesses are advantageous in this respect, whereas the adhesive bonding of very thin and tear-resistant connecting elements repeatedly leads to problems in spite of complicated pretreatments. The avoidance of a special connecting element also means that the flexibility of the band in the region of the connecting point is changed to a lesser extent than when a special connecting element bridging a gap is present.

However, the different orientation of the two bell portions in relation to the grain layer contradicts the hitherto current fundamental conviction that a satisfactory belt run can be achieved only when the belt is designed uniformly over its entire extent. It has been shown, however, that the different orientation of the successive abrasive belt portions scarcely impairs the belt run at all, and that, on the contrary, the greater homogeneity achieved according to the invention in the region of the connecting point is to be valued higher than the difference between the successive belt portions. Despite the different orientation of the abrasive belt portions adjoining one another, the invention thus makes a significant and surprising contribution to the endeavor to render the running properties of a abrasive belt uniform.

The connecting faces are expediently placed in such a way that a direct adhesive bond is made between the longitudinal strength layers at least in a substantial region of the connecting faces. However, this is not absolutely necessary if, as is customary, the abrasive belt substrate is filled with synthetic resin in the boundary region between the two layers to such an extent that sufficient force transmission is guaranteed even when the connecting faces do not reach fully to the associated longitudinal strength layer.

In a first expedient embodiment, the connecting faces lie essentially surface-parallel approximately at that limit of the longitudinal strength layer which faces the transverse strength layer. In many cases, however, it is preferred to have a design, in which the connecting faces run at an acute angle to the limit of the longitudinal strength layer. A first advantage of this design is that the edge strips projection in the region of the recess are thicker at the point where they merge into the region of the undiminished band thickness and therefore the flexibility of the joining section is changed to a lesser extent in relation to the remaining band material. A second advantage is that the method of connection becomes easier, because the edges to be connected, which are provided with adhesive, can be pushed together in the direction of their own extension, that is to say, for example both lying on a flat supporting plate. This can be carried out mechanically and consequently become free of the uncertainties of manual labor. The latter applies particularly when the edges to be connected and their recesses are provided with one or more cooperating stop edges which in a simple and reliable way limit the operation of pushing the edges together.

It is expedient, furthermore, if the connecting faces each intersect the limit of the associated longitudinal strength layer, so as to result in a kind of scarf joint of the longitudinal strength layer, in which the latter participates directly in the adhesive bond resulting in a favorable force profile.

It is expedient, furthermore, to arrange the connecting faces in such a way that the end of the longitudinal strength layer is located in the transverse strength layer. This, in particular, avoids the situation where the notch effect to be expected at this point may have a direct effect on the longitudinal strength layer. Instead, the notch effect is reduced due to the longitudinally greater flexibility of the transverse strength layer.

The edges of those portions in the region of the connecting seam which are to be connected expediently adjoin one another surface-congruently.

In one embodiment of the invention, the longitudinal strength layer is thicker than the transverse strength layer. This not only has to do with the fact that higher forces have to be transmitted in the longitudinal direction than in the transverse direction, but also has advantages for the design of the joint, because a direct adhesive bond between the scarf-joined regions of the longitudinal strength layers is brought about over a greater length via a connecting face which runs at an inclination.

It may also be expedient, however, to make the longitudinal strength layer thinner than the transverse strength layer, the difference corresponding approximately to the thickness of the adhesive layer. This avoids giving rise to a step in the coated abrasive belt surfaces if the connecting face lies exactly in the boundary plane of the two layers.

In contrast, a design, in which the two layers are of equal thickness and also have approximately identical strength values in the direction of their greater strength, has the advantage that said layers can be used alternatively and, if appropriate, in alternation as a longitudinal strength layer, irrespective of their production direction. In this case, the abrasive belt can be manufactured from a standard basic backing the grain layer being applied solely to only one thread layer of the substrate. A coated abrasive belt of this type has, adjacent to a connecting point, substrate segments which in each case differ by approximately 90° in terms of the extension of the production direction, with the result that adhesive bonding of the longitudinal strength layers in the way described above becomes possible.

Those substrates are especially advantageous in which the longitudinal strength layer contains threads which are drawn and run parallel to one another in the band running direction and which expediently contain staple fibers, since these bond particularly well with the surrounding finish and binders. If special requirements are placed on the mechanical properties of the substrate, filament yarn can also be used instead of staple fiber yarn. The transverse strength layer too can contain threads which preferably run in the transverse direction. A particularly suitable substrate is one which contains a textile structure of the type of a thread-ply stitch-bonded material, in which one thread set runs in the longitudinal direction and the other thread set transversely thereto.

The two coated abrasive belt portions to be connected can be arranged in such a way that their longitudinal strength layers have the same production direction and therefore the production top side carries the grain layer in one portion and the production back side carries the grain layer in the other portion. Such a design, suitable particularly for the production of the wide belt, simplifies the requirements placed on the substrate material, because only one layer of the latter is provided as a longitudinal strength layer and the other layer needs to meet only lower requirements based on the mechanical properties. However, since the connection of the band portions is, as a rule, carried out only after graining, this design has the disadvantage that two types of the same cloth have to be available, namely one grained on the top side and one grained on the back side. So that the same substrate can be used for both types, the two surfaces of the substrate must have approximately the same grain carrier quality, to ensure that both can be used as grain carrier faces. It is to be understood by the same grain carrier quality that both sides have the same surface structure and the same adhesiveness in relation to finishes and binders.

The disadvantage of having to grain the substrate on both sides can be avoided if the two layers of the substrate have approximately the same properties of strength and of elongation in their thread running direction and the longitudinal strength layer in one portion is formed by the layer in which the threads run in the production direction, whereas, in the adjacent portion, it is formed by the layer in which the threads run transversely relative to the production direction. Whilst, in the case of the above-described design especially suitable for wide belts, in each case one of the coated abrasive belt segments adjacent to one another are turned around through 180°, in the second embodiment the one segment, rotated through 90° in the same plane relative to the other, is used.

The high homogeneity of the abrasive properties which is achieved according to the invention in the region of the joint makes it possible to enlarge considerably the acute angle between the connecting seam and the direction of extension of the coated abrasive belt, said angle being designated hereafter as the seam angle. Whereas a seam angle of 55°–75° has been considered necessary hitherto, according to the invention it can be enlarged to 60°–90 °.

This has especially advantageous effects in terms of wide coated abrasive belts. In these, the seam angle is usually equal to the angle between the band running direction and the warp thread direction of the individual coated abrasive belt portions. The smaller this angle, the greater the risk that the band will warp and form creases. This may, in practice, lead to the impairment of the ground section and possibly to the destruction of the coated abrasive belt. In the wide coated abrasive belts customary in practice, this risk is overcome by using a large amount of resin in order to reinforce the legible structure. Although there is also the possibility, by suitable design of the textile structure with thread sets running obliquely, to ensure that at least one weft thread set extends in the running direction of the coated abrasive belt (U.S. Pat. No. 4,589,233), nonetheless the production of substrates of this type is highly complicated. Consequently, in spite of some disadvantages, practice has hitherto preferred those said constructions of wide bands in which the direction of the thread structure of the substrate deviates considerably from the band running direction.

By virtue of the enlargement according to the invention of the seam angle, the angle between the band running direction and the force-transmitting longitudinal threads of the individual coated abrasive belt portions decreases and the risk of band warping and of creasing is correspondingly lower. The band needs to be filled with a smaller amount of resin and becomes correspondingly lighter, more flexible and easier to handle. At the same time, a halving of the seam angle corresponds approximately to a halving off the Furthermore, according to the invention, there is the economical possibility, despite the use of standard textile structures oriented at right angles in wide bands, of aligning the longitudinal threads exactly with the band running direction. In particular, the result of enlarging the seam angle is that the segments, from which the coated abrasive belt is to be composed, can be placed, without appreciable cutting waste, in such a way that the cut-to-size longitudinal edges of the band to be manufactured run parallel to the weft thread direction. If warp and weft threads are referred to in this matter, this is not intended to stipulate specific textile structures. On the contrary, this mode of expression is employed to designate those structures in a textile substrate which determine the longitudinal or transverse strength of the latter.

If only a longitudinal strength layer and a transverse strength layer are referred to in the present matter, this is not to imply that the substrate may not also contain further layers. For example, a connecting layer can lie between a thread layer ensuring longitudinal strength and a thread layer provided for transverse strength, or a special surface layer can be provided on one or both layers or the longitudinal and transverse strength layers can each be composed of a plurality of layers. What is to be considered as a longitudinal strength layer in each case depends on the function of this layer, namely of establishing longitudinal strength. Everything else located on that side of the longitudinal strength layer which faces away from the grain side or the abrasive belt back side is almost to be considered as the transverse strength layer. A middle position can be assumed by a connecting layer which is located approximately between them and which may, if appropriate, be considered as part of the longitudinal strength layer if it acts as an adhesion promotor for the adhesive seam bond.

The invention is explained in more detail below with reference to the drawing which illustrates advantageous exemplary embodiments and in which:

FIG. 3 shows an embodiment with a thin longitudinal strength layer

FIGS. 7 and 8 show a diagrammatic representation of a cut-out coated abrasive belt, and FIGS. 9 to 12 show representations of two embodiments of a cut-out wide coated abrasive belt.

Figure 1:
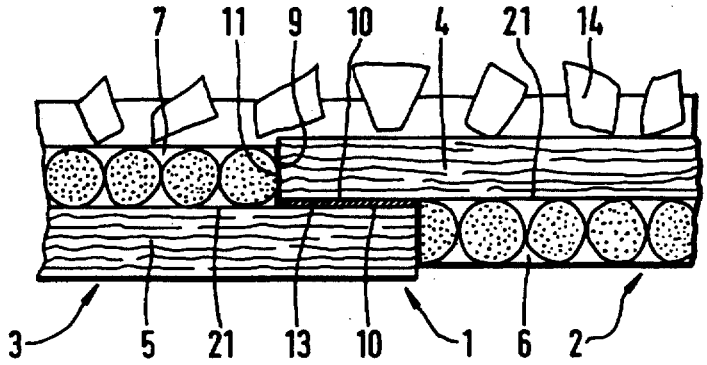
FIG. 1 shows the seam cross section of a first embodiment.

The connecting seam 1 shown in FIG. 1 connects portions 2 and 3 of a coated abrasive belt substrate. The latter consists of two layers, of which the layer 4 shown at the top in portion 2 and the layer 5 shown at the bottom in portion 3 contain the longitudinal strength layer, for example mutually parallel threads 22 of a layer of a thread-ply stitch-bonded material, of which threads it will be assumed that they run parallel to the drawing plane. The other two layers 6 and 7 can comprise threads 22 running correspondingly in the transverse direction and are therefore designated as the transverse strength layer.

Figure 2:
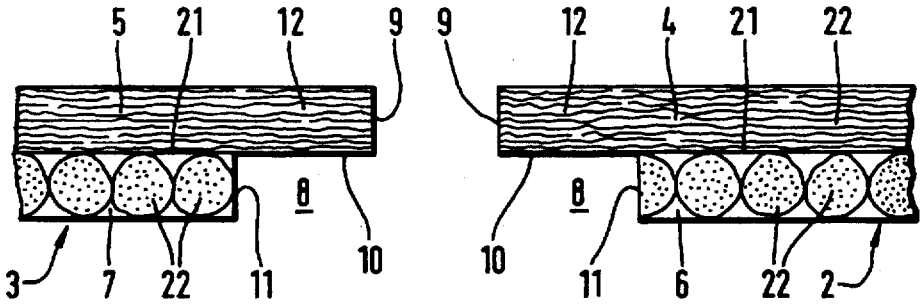
FIG. 2 shows a preliminary stage in the production of this embodiment.

The connecting section shown in FIG. 1 comes about in that, according to FIG. 2, the edges (shown without a grain layer) to be connected to one another are milled out in the region of their transverse strength layers 6 and 7 to form a rebate 8. The edges to be connected are thus limited by an end face 9, by a face 10 of the recess 8, said face 10 running approximately in the direction of the abrasive belt at the boarder line 21 of the longitudinal strength layer and being designated as a connecting face, and by an end face 11 of the recess 8. The two recesses have identical dimensions.

The longitudinal strength layers 4 and 5 can be formed by layers of identical type of the same substrate material, for example, in the production of wide belts, from the weft thread layer of a substrate which contains a thread-ply stitch-bonded material. To make the joining section according to FIG. 1, one portion 3 is then rotated through 180° relative to the other portion 2 and the edges to be connected are pushed one into the other in such a way that their projecting edge strips of the longitudinal strength layer come to rest in each case in the recess 8 of the other portion. In this position, they are connected to one another by means of an adhesive layer 13 between the connecting faces 10 and the end faces 9, 11. It can be seen that the longitudinal forces can pass over from one longitudinal strength layer 4 into the other longitudinal strength layer 5 without the intermediary of a special connecting element. It can also be seen that flexibility in the seam region is not disturbed by the use of a connecting element being different from the remaining coated abrasive belt material.

The grain layer 14 is carried by the longitudinal strength layer 4 in the segment 2 and by the transverse strength layer 7 in the portion 3. This presupposes that both surfaces of the basic material satisfy the minimum preconditions for grainability. If the substrate is grained before the coated abrasive belt is fabricated and assembled, the basic material must be present in two different types which each carry the graining on different sides. This requirement is avoided if the substrate is assembled before graining.

The need to provide differently grained basic material is avoided if the longitudinal strength layers 4 and 5 of the two portions 2 and 3 do not belong to the same textile layers of the basic material, but to different ones. Thus, for example, the longitudinal strength layer of the portion 2 can be formed by the warp thread layer of the basic material, whilst the longitudinal strength layer 5 of the portion 3 is formed by the weft thread layer of the basic material. The two portions 2 and 3 are then, in the assembled state, rotated through 90° relative to one another in the same plane. This design presupposes that the two layers of the basic material each have approximately identical mechanical properties in terms of strength and elongation in the direction of their strength-imparting strands. It is not necessary that their surfaces must be capable of being grained in the same way, because the grain layer is applied on the same side of the basic material in both portions.

In each case the completed abrasive belt consists of at least two, in any case an even number of portions with a corresponding number of connecting joints.

The joint according to the invention can easily be produced mechanically and therefore in a uniformly reliable manner, because no connecting element has to be inserted. On the contrary, the edges to be connected, after they have been provided with adhesive, can easily be pushed together automatically, until their end faces 9, 11 butt together, and then, if appropriate, can be pressed and treated for the purpose of curing the adhesive. This pushing together of the edges to be connected takes place more easily in the embodiments described further below, having a connecting face running obliquely, insofar as they are also provided with stop faces 9, 11.

It can be seen form the exemplary embodiment according to FIG. 1 that the surfaces of the edges joined together are offset stepwise slightly relative to one another by the thickness of the adhesive layer 13. This can be avoided if, according to FIG. 3, the longitudinal strength layer is reduced by the amount of the thickness of the adhesive layer or if the connecting faces 10 are arranged obliquely according to the following embodiments.

Figure 4:
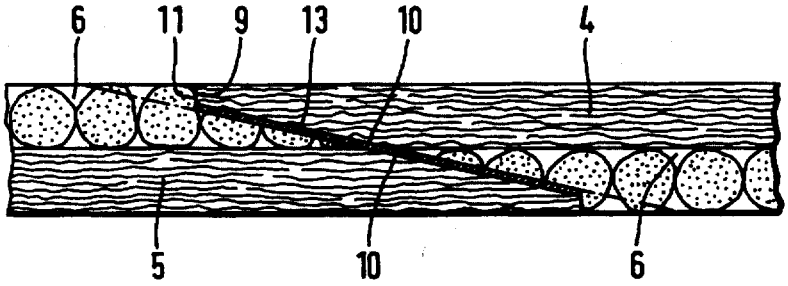
FIGS. 4 to 6 show further embodiments.

In the embodiment according to FIG. 4, the longitudinal strength layers 4, 5 and the transverse strength layers 6, 7 are of equal thickness. The recess has an oblique connecting face 10. In this case, the recess is not only located in the transverse strength layer 6 or 7, but extends beyond this into the longitudinal strength layer. The advantage of this design is that the threads contained in the longitudinal strength layers 4 and 5 are contacted by the adhesive layer 13 over a large part of their cross-sectional extent, so that highly uniform force transmission can take place. This avoids the situation where a considerable part of this force transmission takes place over longitudinally less resistant pads of the transverse strength layers 6 and 7. In comparison with the construction according to FIG. 1, this embodiment avoids the risk of damage to the longitudinal strength layer when the recess is being milled out as well as a production-related deviation in the milled-out depth which may cause a stepwise transition of the adjacent segments. In this embodiment of the invention, too, the edges to be connected to one another have stop faces 9, 11 which make it easier to join said edges together exactly. If this effect is unnecessary, the connecting faces can also be led straight through from one surface to the other, as indicated by dot-and-dash lines.

Figure 5:
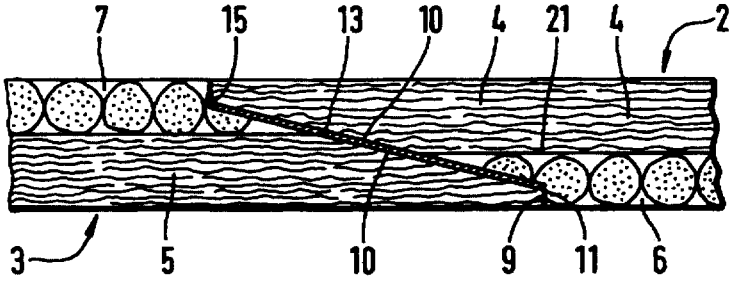

The embodiment according to FIG. 5 differs from that according to FIG. 4 in that the longitudinal strength layers 4 and 5 are made thicker than the transverse strength layers 6 and 7. As a result, the connecting faces 10 exceed, on both sides of the adhesive layer 13, the limits 21 of the longitudinal strength layers and directly intersect these layers in the region of long stretches located opposite one another, so that a direct and large-area connection of the longitudinal strength layers can come about. In this case, the inner edges 15 of the recesses lie within the transverse strength layers 6 and 7 at some distance in thickness from the layer limit of the longitudinal strength layers 4, 5. The strength of the longitudinal strength layers is therefore not impaired by notch effects which emanate from the edges 15. It is expedient if said direct connection of the longitudinal strength layers is present within a range of a particular minimum length which corresponds at least approximately to the thickness of the longitudinal strength layer, but preferably to more than five times this thickness.

Figure 6:
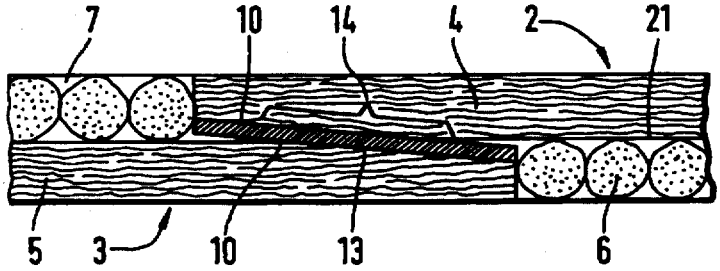

Only those coated abrasive belt arrangements are suitable for the embodiment of the connection according to FIG. 5 in which, in each case, one of the segments adjacent to one another is rotated through 180°, and in which the longitudinal strength layers 4 and 5 therefore have the same orientation relative to the production direction (for example, warp or weft direction) as is the case in wide coated abrasive belts. If the intention is to have the freedom to use another arrangement, in which, for example, successive portions are rotated through 90°, it is expedient to resort to the embodiment according to FIGS. 4 or 6, in which the layers are of approximately the same thickness and therefore have approximately the same mechanical properties in their respective directions, The design according to FIG. 6 resembles that according to FIG. 4 having the angled recess, the difference being that the connecting faces 10 are guided at a highly acute angle to the longitudinal direction and the adhesive layer 13 is made relatively thick. This results, within the connecting stretch, in a relatively long portion 14, in which the intersected surfaces of the longitudinal strength layer are located directly opposite one another and are connected directly to one another, without part of the transverse strength layer being interposed. This is recommended when the longitudinal strength of the transverse strength layer is unusually low.

FIGS. 7 and 8 illustrate the assembly of a coated abrasive belt (FIG. 8) from the cutouts of a basic fabric width (FIG. 7), the two layers of which each have approximately the same mechanical properties in their direction. Suitable for this purpose is a substrate containing a thread-ply stitch-bonded material which has approximately identical strength and elongation in the warp and weft direction. For example, a staple fiber yarn having the strength Nm 12 can be used both for the warp thread and for the weft thread, whilst the stitching thread consists of polyester filaments of dtex 76. The thread density of the warp or weft threads is almost identical to 36 threads per inch. To achieve a smooth surface, the warp threads are tied in a high/low weave, at least two warp threads being located within a needle gap.

In each of the two representations, the warp direction is indicated by longitudinal hatching. A portion B is inserted between the ends of the portion A of any length for the connection of the latter, said portion B being cut out from the same basic cloth in the arrangement indicated in FIG. 7. This portion B is inserted, rotated through 90° relative to the portion A in the same plane, so that, as indicated in FIG. 8 by the hatching, the warp thread direction runs transversely and the longitudinal strength layer is formed by the weft thread layer. The basic fabric can be grained before the fabrication of the coated abrasive belt, the grain layer in the portions A and B being located on the same side of the substrate, but, in one case, one the transverse strength layer and, in the other case, on the longitudinal strength layer of the coated abrasive belt.

FIGS. 9 and 10 show the fabrication of a wide belt from two webs I and II of the basic fabric, the substrates of which are identical, but are grained on different sides. In principle, however, the coated abrasive belt can also be produced from one and the same web of ungrained basic fabric and be grained subsequently. Portions from the webs I and II are inserted alternately in the coated abrasive belt (FIG. 10), the portions from the web II being rotated relative to those from the web I. This is made clear in FIG. 10 by the fact that the weft thread direction indicated by cross hatching in FIG. 9 is represented by unbroken lines in the portions A and B of the coated abrasive belt which come from the fabric I and by broken lines in the portions C and D coming from the fabric II. In all the portions, the warp thread direction runs parallel to the direction of the seams 16 which are inclined at the seam angle alpha relative to the direction of the belt edge 17. The weft direction 18 runs perpendicularly to the seam direction and is therefore inclined at the seam angle alpha relative to the perpendicular 17 to the band running direction. Since the favorable properties of the coated abrasive belt joint according to the invention permit a large seam angle alpha, this deviation of the weft thread direction from the band running direction is insignificant and the resin finishing of the coated abrasive belt can therefore be easier than usual.

If the coated abrasive belt portions 20 of the wide band illustrated in FIG. 12 are cut out of the basic cloth in the way shown in FIG. 11, the weft threads run exactly in the band running direction. This is therefore economically possible because the cutting waste, indicated by dots in FIG. 11 and caused by a large seam angle which, according to the invention, can be more than 80°, is very slight.

We claim:

1. A coated abrasive belt comprising a flexible substrate and an abrasive grain layer on one side thereof, said abrasive belt having a belt running direction, said substrate comprising a longitudinal strength layer (4,5), designed for absorbing the largest part of the forces appearing in the belt running direction, and a transverse strength layer (6, 7), designed for absorbing the larger part of the forces extending transversely relative to the belt running direction; said belt having at least two end portions (2,3) connected to one another by means of at least one adhesive seam (1) extending transversely relative to the belt running direction; each of said end portions having a recess on the side of the transverse strength layer (6, 7), said recess (8) forming a connecting seam face (10) which extends approximately in said belt running direction and reaches at least near to the longitudinal strength layer (4, 5) to define a seam strip of the longitudinal strength layer (4, 5), each of said seam strips being complementary to and projecting into the recess (8) of the other end portion, the connecting faces (10) of the two recesses being adhesively bonded directly to one another, one of said two portions (2) carrying said grain layer (14) on its longitudinal strength layer (4) and the other portion (3) carrying it on its transverse strength layer (7).

2. The coated abrasive belt as claimed in claim 1, wherein the longitudinal strength layers (4, 5) are adhesively bonded directly to one another.

3. The coated abrasive belt as claimed in claim 1, wherein the substrate provides an interface (21) between the longitudinal and transverse strength layers and the connecting faces (10) are positioned approximately at that interface.

4. The coated abrasive belt as claimed in claim 1, wherein the substrate provides an interface between the longitudinal and transverse strength layers and the connecting faces (10) run at an acute angle to the interface.

5. The coated abrasive belt as claimed in claim 4, wherein the connecting faces (10) intersect the interface.

6. The coated abrasive belt as claimed in claim 5, wherein a free end (15) of the connecting face (10) of one end portion extends through a portion of the thickness of the transverse strength layer (6, 7).

7. The coated abrasive belt as claimed in claim 4, wherein the regions of the longitudinal strength layer (4, 5) exposed in the connecting faces (10) are located directly opposite one another in a part of the seam (14), the length of which is at least approximately equal to the thickness of the longitudinal strength layer (4, 5).

8. The coated abrasive belt as claim in claim 1, wherein the seam strips adjoin one another surface-congruently.

9. The coated abrasive belt as claimed in claim 1, wherein the longitudinal and transverse strength layers (4, 5; 6, 7) are of equal thickness.

10. The coated abrasive belt as claimed in claim 1 wherein the longitudinal strength layer (4, 5) is thicker than the transverse strength layer (6, 7).

11. The coated abrasive belt as claimed in claim 1, wherein the longitudinal strength layer (4, 5) is thinner than the transverse strength layer.

12. The coated abrasive belt as claimed in claim 1, wherein the quality of the grain layer is approximately the same on the two end portions.

13. The coated abrasive belt as claimed in claim 1, wherein the longitudinal strength layer (4, 5) contains threads (22) which are drawn and run parallel to one another.

14. The coated abrasive belt as claimed in claim 13, wherein the threads (22) contain staple fibers.

15. The coated abrasive belt as claimed in claim 13, wherein the transverse strength layer (6, 7) contains threads (22) which run in the transverse direction.

16. The coated abrasive belt as claimed in claim 15, wherein both layers (4, 5; 6, 7) have approximately the same properties of strength and of elongation in their thread running direction and the longitudinal strength layer (4) in one portion (2) is formed by the layer in which the threads run in the production direction, whilst, in the other portion (3), it is formed by the layer (5), in which the threads run transversely relative to the production direction.

17. The coated abrasive belt as claimed in claim 13, wherein the substrate contains a textile structure of the type of a thread-ply stitch-bonded material.

18. The coated abrasive belt as claimed in claim 13, wherein the longitudinal strength layers (4, 5) have the same production direction in both portions (2, 3) and the production top side carries the grain layer (14) in the other portion.

19. The coated abrasive belt as claimed in claim 18, wherein the threads of the longitudinal strength layer extend in the belt running direction and the seam angle alpha between the adhesive seam and the belt running direction is between 60° and 90°.

20. The coated abrasive belt as claimed in claim 1, wherein the seam strips and recesses (8) form stop faces (9, 11) running transversely relative to the belt plane.

21. The coated abrasive belt as claimed in claim 1, wherein the seam angle alpha between the adhesive seam (16) and the belt running direction (17) is more than 80°.

* * * * *